US006504509B2

(12) United States Patent
Määttä

(10) Patent No.: US 6,504,509 B2
(45) Date of Patent: Jan. 7, 2003

(54) HINGED ELECTRONIC DEVICE OF TRANSMITTER/RECEIVER

(75) Inventor: Esa Määttä, Tampere (FI)

(73) Assignee: Nokia Mobile Phones Ltd., Espoo (FI)

( * ) Notice: Subject to any disclaimer, the term of this patent is extended or adjusted under 35 U.S.C. 154(b) by 0 days.

(21) Appl. No.: 09/727,222

(22) Filed: Nov. 30, 2000

(65) Prior Publication Data

US 2001/0002825 A1 Jun. 7, 2001

(30) Foreign Application Priority Data

Dec. 3, 1999 (FI) ..... 992611

(51) Int. Cl.[7] ..... H01Q 1/24
(52) U.S. Cl. ..... 343/702
(58) Field of Search ..... 343/702, 805, 343/901, 885, 895, 893, 906, 882, 889; H01Q 1/12, 1/24

(56) References Cited

U.S. PATENT DOCUMENTS

| | | | | | |
|---|---|---|---|---|---|
| 3,579,241 | A | * | 5/1971 | Santo et al. | 343/805 |
| 4,126,863 | A | | 11/1978 | Kolwaite | 343/702 |
| 4,136,344 | A | * | 1/1979 | Nakao et al. | 343/702 |
| 4,653,951 | A | * | 3/1987 | Bodle et al. | 343/885 |
| 4,989,015 | A | * | 1/1991 | Chang | 343/915 |
| 5,189,632 | A | * | 2/1993 | Paajanen et al. | 364/705 |
| 5,335,368 | A | * | 8/1994 | Tamura | 343/702 |
| 5,504,494 | A | * | 4/1996 | Chatzipetros et al. | 343/702 |
| 5,554,996 | A | * | 9/1996 | Chatzipetros | 343/702 |
| 5,576,719 | A | * | 11/1996 | Gerszberg et al. | 343/702 |
| 5,644,320 | A | | 7/1997 | Rossi | 343/702 |
| 6,095,820 | A | * | 8/2000 | Luxon et al. | 343/841 |

FOREIGN PATENT DOCUMENTS

| | | |
|---|---|---|
| DE | 19525047 A1 | 1/1996 |
| FI | 85776 | 2/1992 |
| WO | WO 93/18591 | 9/1993 |
| WO | WO 97/23936 | 7/1997 |
| WO | WO99/14817 | 3/1999 |

OTHER PUBLICATIONS

English translation of the Abstract of Japanese Patent Application No. JP11266107.

* cited by examiner

*Primary Examiner*—T Phan
(74) *Attorney, Agent, or Firm*—Perman & Green, LLP

(57) ABSTRACT

A hinged electronic device comprising a base part, hinges and a cover part, the cover part being arranged rotatably with relation to the base part about the rotation axis of the hinges. The device also comprises at least one antenna structure to which is arranged an antenna and which is arranged substantially concentrically with the rotation axis of the hinges.

9 Claims, 2 Drawing Sheets

HINGED ELECTRONIC DEVICE OF TRANSMITTER/RECEIVER

CROSS-REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

Figure 1:
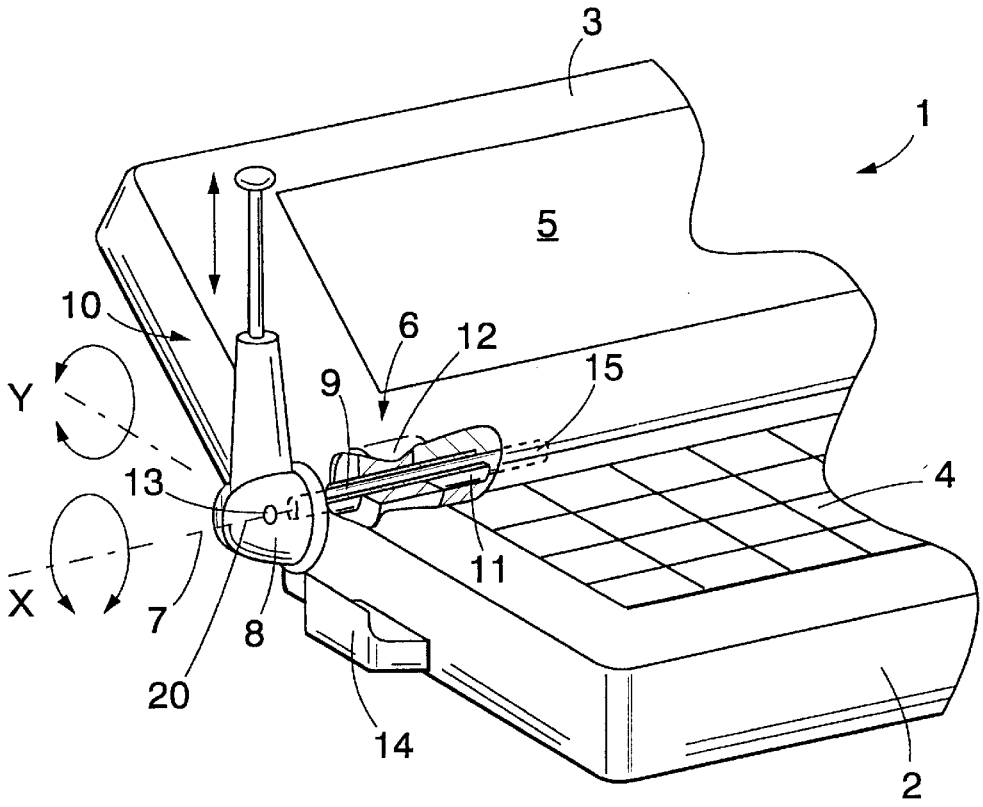

The invention relates to a hinged electronic device of transmitter and/or receiver type, the device comprising a base part, hinges, a cover part that is arranged to be rotatable in relation to the base part about the rotation axis of the hinges, an antenna, an RF circuit and an RF conductor that is arranged to connect the RF circuit to the antenna.

2. Description of the Related Art Including Information Disclosed Under 37 CFR 1.97 and 1.98.

Some electronic devices of transmitter and/or receiver type comprise a base part and a cover part that is rotatably attached thereto by hinge means. Such electronic devices—in the following referred to as the device—typically include mobile phones, portable computers or combinations thereof and the like. To improve portability and manageability of the device, for instance, the base part and the cover part of the device can be folded against one another. On the other hand, by folding the device open, i.e. the cover part apart from the base part, a display extending substantially throughout the cover part will be generally available for use, and correspondingly, a keyboard extending substantially throughout the base part. Nokia 9000 Communicator is known as an example of this kind of a device.

Electronic components of said devices are mainly arranged in the base part, whereas a display and possibly some of the operating means are commonly arranged in the cover part. An antenna or antennae of the devices are also arranged in the cover part, because in a position in which the device is normally used, i.e. the base part set in a substantially horizontal position and the cover part lifted upwardly, the cover part takes a more advantageous position in view of the antenna operation.

Conductors are arranged between the base part and the cover part for interconnecting the electronic components placed in different parts in a required manner. Bending stress in particular, but also other mechanical stresses are exerted on said conductors every time the angle between the base part and the cover part is changed. The stress is often increased by minor bending radii of the conductors. In particular, the typically coaxial RF cable that interconnects the antenna structure and the RF (Radio Frequency) circuit is easily damaged by said bending stress. Sooner or later, damages in the RF cable lead to disturbances essentially impeding the operation of the device or even to complete inoperability. Furthermore, the angle of rotation between the base part and the cover part has to be limited so as to reduce the bending of the RF cable, and consequently, depending on the device or the device type, it is not necessarily possible to open the device such that the operating position would be ideal in view of ergonomics and working environment. Still further, when assembling the device, installing the RF cable from the base part to the cover part during assembly is a cost intensive step requiring particularly great precision and carefulness. Correspondingly, handling of the conductor is often difficult in connection with maintenance or repair measures.

WO 97/23936 discloses a solution, which aims to reduce bending stress exerted on the conductors by supplying the conductors from the base part to the cover part through a rotatable connecting piece that reduces their bending angle. Even though the solution according to the publication works well as compared with previous solutions, the RF conductor is still subjected to bending stresses that may result in conductor damage in time. Moreover, it is relatively laborious to install an RF conductor in connection with this solution as well.

The object of the present invention is to provide a hinged electronic device which avoids the above-described drawbacks.

BRIEF SUMMARY OF THE INVENTION

The hinged electronic device of the invention is characterized by comprising an antenna structure to which an antenna is arranged, the antenna structure being arranged substantially immobile in relation to the device part comprising the RF circuit such that the centre axis of the antenna structure is substantially concentric with the rotation axis of the hinges.

The basic idea of the invention is that the device's antenna structure, to which the RF conductor is coupled, is arranged concentrically with the rotation axis of the hinges between the base part and the cover part such that when the cover part is rotated in relation to the base part about said rotation axis, the antenna will not rotate substantially in relation to the base part, whereby the RF conductor is not subjected to substantial bending stresses caused by rotation. Further, the idea of one preferred embodiment is that said antenna structure and a pivot pin of at least one hinge are integrated, whereby the number of device components can be reduced. Still further, the basic idea of a second preferred embodiment is that at least one external antenna is arranged with a joint to the antenna structure, allowing the antenna to rotate about at least one spatial axis in relation to the antenna structure. The idea of yet a third preferred embodiment is that an internal antenna is arranged to the antenna structure.

The invention has an advantage that when rotating the cover part in relation to the base part, the RF conductor is not subjected to bending stresses caused by the rotation nor to damage resulting therefrom, whereby service life and reliability of the RF conductor improve. Moreover, the assembly of the device becomes easier and simpler, because there is no need to pass the conductor through from the base part to the cover part, and regarding the length and installation of the conductor, there is no need to take into account how the conductor behaves in rotation. It is also easier to maintain and repair the device, because the RF conductor runs all the time in one and the same part of the device. Yet another advantage is that there is no need to limit the angle of rotation between the base part and the cover part because of the RF conductor. An advantage of one preferred embodiment is also that the antenna and the pivot pin being integrated the number of components reduces, which reduces the amount of installation measures required in assembly and costs resulting from component handling.

BRIEF DESCRIPTION OF THE SEVERAL VIEWS OF THE DRAWING(S)

Figure 2:
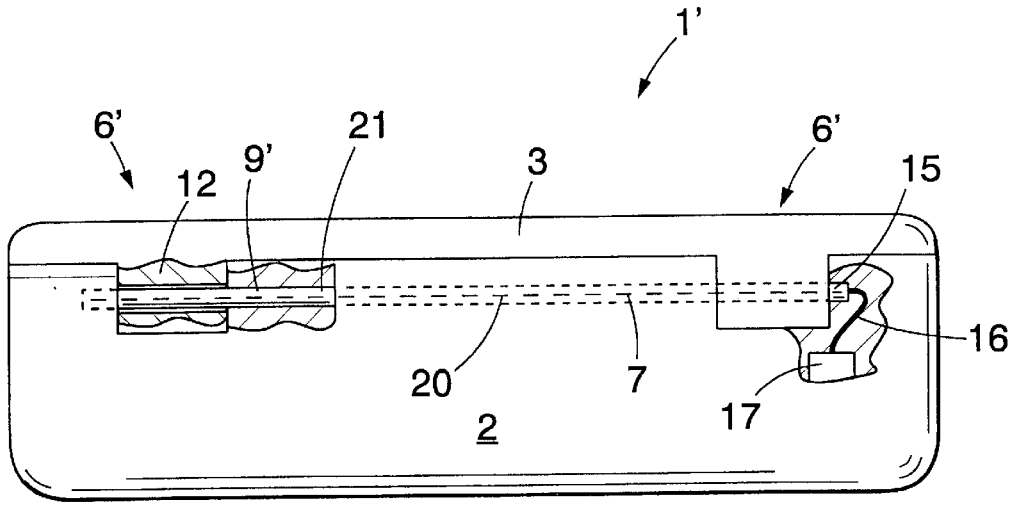
Figure 3:
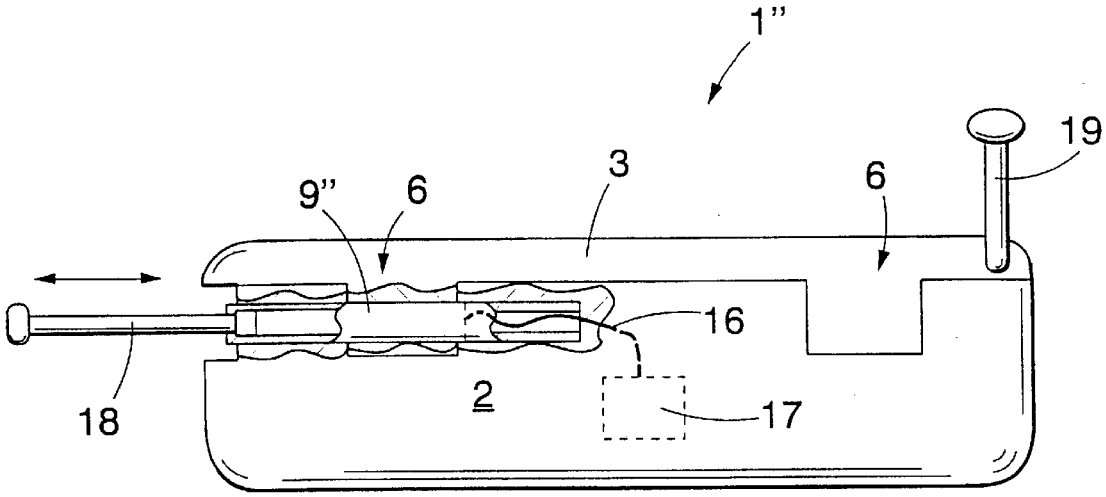

The invention will be described in greater detail with reference to the attached drawings wherein FIG. 1 is a schematic view of a part of one embodiment of the device in accordance with the invention in perspective and partly cut open;

FIG. 2 is a schematic side view of a second embodiment of the device in accordance with the invention partly cut open; and FIG. 3 is a schematic side view of a third embodiment of the device in accordance with the invention partly cut open.

DETAILED DESCRIPTION OF THE INVENTION

FIG. 1 is a schematic perspective view of a part of a hinged electronic device in accordance with the invention. The main parts of the device 1 comprise a base part 2 and a cover part 3 arranged on the upper edge of said base part. Typically, a keyboard 4 and other similar means required for operating the device are arranged in the base part 2; a majority of the electronic components of the device 1 is also generally arranged in the base part 2. A display 5, which is of the type of a liquid crystal display or a similar flat-panel display, is in turn arranged in the cover part 3. Disposition of the components of the device 1 can also be different from what is presented here. For instance, the cover part 3 can be arranged on either side of the base part 3 or on the lower edge thereof; the keyboard 4 can be arranged either completely or partly in the cover part 3. Displays, keyboards, switches or other components known per se can be arranged on the outer surfaces—not shown in the figure—of the base part 2 and the cover part 3. It should also be noted that the device of the invention may comprise more parts rotatable in relation to one another than one base part 2 and one cover part 3.

The base part 2 and the cover part 3 are arranged rotatably to one another by hinges 6 which are arranged between the base part 2 and the cover part 3 in a suitable manner. The hinge 6 comprises a hollow, cylindrical pivot pin 11 attached substantially immovable to the base part 2 and a hinge sleeve 12 arranged rotatably about said pivot pin, the hinge sleeve 12 being in turn secured to the cover part 3. Thus, the cover part 3 can be rotated in relation to the base part about the pivot pin 11, the rotation axis 7 being at the center axis of the pivot pin. An opposite arrangement is also possible, whereby the hinge sleeve 12 is secured to the base part 2 and the pivot pin 11 to the cover part 3. The hinge 6 can also be implemented in other manners known per se to the person skilled in the art. The material of the hinge sleeve 12 is in most cases metal or reinforced or non-reinforced plastic. To interconnect the components arranged in the base part 2 and the cover part 3, conductors and buses are arranged between the parts 2, 3 in a manner known per se, which conductors and buses are not shown in the FIG. 1, however, for the sake of clarity.

In the embodiment of FIG. 1, the pivot pin 11 is a hollow, tube-like means which is most preferably made of metal or reinforced or non-reinforced plastic and which is locked in a known manner to the base part 2. An antenna structure 9 of the device 1 is arranged substantially immovably inside the pivot pin 11 to be coaxial in such a manner that the center axis 20 of the antenna structure 9 is substantially at the rotation axis 7 of the hinge 6. The antenna structure 9 is connected with an RF conductor to an RF circuit in the base part 2 of the device. It should be noted that for the sake of clarity FIG. 1 does not show the RF conductor, nor the RF circuit, but these components are known per se to the person skilled in the art. The RF conductor is typically a coaxial cable which is connected at one end to said RF circuit and at the other end to the antenna structure 9. In the embodiment shown in the figure, the RF conductor is connected to the opposite end of the antenna structure 9 with relation to a joint 8. Since the antenna structure 9 is arranged to be substantially immovable in relation to the pivot pin 11 and further the base part 2, the RF conductor is not subjected to any bending stresses or other mechanical strains when the cover part 3 is rotated in relation to the base part 2. Consequently, the RF conductor will not be damaged mechanically and the reliable service life will increase substantially as compared with the prior art solutions. To pass the RF conductor from the base part to the cover part, which is known as a particularly time-consuming step in the assembly of prior 5 art devices, becomes unnecessary, which reduces assembly costs of the device. Correspondingly, said step will be omitted, for instance, in such maintenance or repair measures that require detaching the cover part 3 from the base part 2.

Instead of the hinge solution implemented in the embodiment of FIG. 1, the pivot pin 11 can be locked in the hinge sleeve 12, whereby the ends of the pivot pin 11 are arranged rotatably in mating recesses provided in the base part 2. In that case, the antenna structure 9 is secured directly to the base part 2 and the pivot pin 11 rotates about it.

A joint 8 is rotatably secured to one end of the antenna structure 9, to which joint is arranged an external antenna 10 such that the position of said external antenna and the antenna structure 9 can be adjusted in relation to one another about the axis of the joint 13. Moreover, since the joint 8 is rotatably arranged in relation to the antenna structure 9 and hence also in relation to the base part 2, the position of the external antenna 10 can be adjusted in relation to two perpendicular spatial axes X and Y. Furthermore, the external antenna 10 has a telescopic structure, which allows-length adjustment as well. All in all, there are extremely versatile possibilities to adjust the external antenna 10, which enables optimization of transmission and/or reception characteristics of the device to meet the needs at all times. It should be noted in this connection that the dimensions of the antenna structure 9 and the external antenna 10 shown in the figure, like all other dimensions of the device 1, are given by way of example only.

A holder 14 is provided on one side of the base part 2 for the external antenna 10, in which holder the external antenna can be arranged so that it is firmly and reliably protected, for instance, during transportation of the device 1.

FIG. 1 does not show other hinges of the device 1, which are arranged between the base part 2 and the cover part 3 in the device 1 in the same manner as the hinge 6. Their structure is similar to known hinges, and an antenna is not necessarily arranged in connection therewith. In some embodiments of the device 1, due to the extent of the device's field of use, or for some other reason, it is necessary to use a second antenna in addition to the external antenna 10. In that case, the second antenna can be placed in connection with the other hinge in the same manner as the external antenna 10 but on the opposite edge of the device 1.

FIG. 2 shows a schematic side view of a second embodiment of the device of the invention partly cut open. The device 1' is shown such that the base part 2 and the cover part 3 are folded against one another. The base part 2 and the cover part 3 are arranged rotatably with one another by two hinges 6', the hinge sleeve 12 of the hinges 6' being secured to the cover part 3. The hinges 6' have no separate pivot pins but the antenna structure 9' serves as the pivot pin for both hinges 6'. In other words, the antenna structure 9' of the device 1' is integrated with the pivot pins and the antenna structure 9' extends through both of the hinges 6' such that the center axis 20 of the antenna structure 9' is coaxial with the rotation axis 7 of the hinges 6'. Thanks to the integration of the antenna structure 9' and pivot pins, the device 1' can be constructed without separate pivot pins. This reduces the number of components in the device 1', which in turn reduces the manufacturing and logistic costs of the device 1'. Even though the number of hinges 6' in the embodiment of FIG. 2 is two, any number of hinges is possible. The RF conductor 16 is connected to one end 15 of the antenna structure 9' and to the RF circuit 17 in a manner known per se.

In the embodiment of FIG. 2, the antenna structure 9' acts also as an internal antenna 21 of the device 1'. Thus, the device 1' comprises two antennae: an external antenna 10 and an internal antenna 21. One reason for comprising the internal antenna 21 in addition to the external antenna 10 can be, for instance, that the device 1' operates in two different frequency bands, the external antenna 10 being optimized to operate in one band, and correspondingly, the internal antenna 21 in the other frequency band, or then there is some other reason.

In one embodiment of the invention, the device comprises only an internal antenna 9' and no external antenna 10 at all. Then, outside the device there are no protruding antennae which in some cases may impede the handling of the device, or which may be exposed to damage from impacts or other similar forces outside the device.

FIG. 3 shows a schematic side view of a third embodiment of the device of the invention partly cut open. The antenna structure 9" is arranged concentrically with the rotation axis of the hinges 6. A retractable antenna 18 is arranged inside the antenna structure 9", which retractable antenna can be extended from the antenna structure 9", when needed. On the other hand, while being pushed inside the antenna structure 9" and the device 1", the retractable antenna 18 is well protected against damage caused by outside factors.

Apart from the retractable antenna 18, the device 1" comprises a second antenna 19. Even though the second antenna 19 in the embodiment of FIG. 3 has a prior art structure, it can also be implemented in accordance with the present invention.

The drawings and the specification related thereto is only intended to illustrate the inventive idea. The invention may vary in detail within the scope of the claims. So, the device may comprise more than two antennae, of which some can be prior art antennae. The RF circuit 17 of the device 1 may also be arranged in the cover part 3, whereby the antenna structure 9, 9', 9" of the invention is naturally arranged to be immovable in relation to said cover part 3.

What is claimed is:

1. A hinged transmitter- and/or receiver electronic device, the device comprising; a base part having electronic components, hinges, a cover part that is arranged rotatably with relation to the base part about the rotation axis of the hinges, an antenna, an RF circuit and an RF conductor that is arranged to connect the RF circuit to the antenna, an antenna structure to which the antenna is arranged and which antenna structure is arranged to be substantially immobile with relation to the part of the device comprising the RF circuit such that the center axis of the antenna structure is substantially coaxial with the rotation axis of the hinges, wherein the antenna structure comprises an internal antenna of the device.

2. A device as claimed in claim 1, wherein a pivot pin of at least one hinge to be inserted in a hinge sleeve is arranged to envelop at least part of the antenna structure.

3. A device as claimed in claim 1, wherein the antenna arranged in the antenna structure is an external antenna.

4. A device as claimed in claim 3, wherein the external antenna is a retractable antenna.

5. A device as claimed in claim 3, wherein the antenna structure is arranged to be the pivot pin of at least one hinge sleeve.

6. A device as claimed in claim 3, wherein the external antenna is arranged in the antenna structure with a joint such that the external antenna is rotatable about at least one spatial axis with relation to the antenna structure.

7. A device as claimed in claim 6, wherein the external antenna is arranged rotatable about two spatial axes perpendicular to each other.

8. A device as claimed in claim 1, wherein the antenna structure is at least partly hollow and at least part of the RF conductor is arranged inside said antenna structure.

9. A device as claimed in claim 1, wherein the device comprises at least two antennae.

* * * * *